US005167481A

United States Patent [19]

Gotz

[11] Patent Number: 5,167,481

[45] Date of Patent: Dec. 1, 1992

[54] FORKLIFT VEHICLE

[75] Inventor: Bernhard Gotz, Aschaffenburg, Fed. Rep. of Germany

[73] Assignee: Linde Aktiengesellschaft, Fed. Rep. of Germany

[21] Appl. No.: 700,474

[22] Filed: May 15, 1991

[30] Foreign Application Priority Data

May 22, 1990 [DE] Fed. Rep. of Germany ..... 4016495
Jul. 14, 1990 [DE] Fed. Rep. of Germany ..... 4022450

[51] Int. Cl.[5] ..... B66F 9/10; B66F 9/22

[52] U.S. Cl. ..... 414/635; 280/756; 296/102; 414/914

[58] Field of Search ..... 414/628-638, 414/914; 296/102; 280/756

[56] References Cited

U.S. PATENT DOCUMENTS

| | | | |
|---|---|---|---|
| 2,263,981 | 11/1941 | Dalecke et al. | 414/634 |
| 3,997,029 | 12/1976 | Evans | 414/635 X |
| 4,067,393 | 1/1978 | Szarkowski | 414/636 X |
| 4,095,839 | 6/1978 | Lawrence et al. | 414/914 X |
| 4,207,967 | 6/1980 | Stedman | 414/914 X |
| 4,266,808 | 5/1981 | Fassett | 414/914 X |
| 4,325,464 | 4/1982 | Larsson | 414/631 X |
| 5,082,090 | 1/1992 | Walker | 414/631 X |

FOREIGN PATENT DOCUMENTS

| | | | |
|---|---|---|---|
| 8602229 | 1/1986 | Fed. Rep. of Germany . | |
| 1098856 | 6/1984 | U.S.S.R. | 296/102 |

*Primary Examiner*—David A. Bucci
*Attorney, Agent, or Firm*—Webb, Burden, Ziesenheim & Webb

[57] ABSTRACT

A forklift vehicle having a tiltable lift frame on its forward end which can be inclined relative to a horizontal axis located on the front of the vehicle. Spaced vertical support columns located on the rear of the vehicle and a cross member connecting the upper ends of the support columns. A driver cab on the vehicle positioned between the lift frame and the support columns. A protective cover over the driver cab including a support element which is mechanically connected to the lift frame and to a support column.

5 Claims, 3 Drawing Sheets

FORKLIFT VEHICLE

BACKGROUND OF THE INVENTION

1. Field of the Invention

The invention relates generally to a forklift vehicle having a lift frame at its forward end which can be pivoted about a horizontal transverse axis which is located at the forward end of the vehicle and which is substantially parallel to the roadway. The forklift vehicle includes a protective cover for the driver located above the cab and the cover includes items which are mechanically linked to the lift frame to pivot the lift frame about the aforementioned horizontal axis.

2. Related Prior Art

A forklift vehicle as generally described above is disclosed in German Utility Patent DE-GM 86 02 229. This forklift vehicle and other forklift vehicles of the prior art have the problem that when the carrier rack is raised to a substantial height utilizing large lifting power, significant torsion forces are created on the lift frame. Such forces can, for example, be created by an off-center load on the forks of the carrier rack. Lateral forces acting on the load can create bending moments in the lift frame during travel of the vehicle. These forces can cause deformations of the lift frame and if these deformations oscillate or alternate they can cause fatigue rupture of the lift frame.

The installation of a support element as disclosed in the above-mentioned prior art patent is intended to eliminate the oscillation or alternation of the deformations. The support element is a linear guide formed by a roller-guided connecting rod, which is capable of absorbing transverse forces and preventing warping or twisting of the lift frame. A disadvantage of such forklift vehicles is that they have a substantial height.

SUMMARY OF THE INVENTION

The present invention is a forklift vehicle which has a reduced overall height and a simplified and inexpensive construction. This is achieved by providing two spaced parallel support elements which are substantially parallel to the longitudinal axis of the vehicle. The support elements are preferably integrated into the protective cover of the cab as load bearing elements and are rigidly connected to each other.

The arrangement described above results in a forklift vehicle wherein the size and the configuration of the cab located below the driver protective cover are maximized to establish optimum upward sight lines. This is possible because the driver protective cover is not a part of the cab as in prior art forklift vehicles. The simple construction of the cab and the vehicle frame results in a significant reduction in the manufacturing and assembly costs of the vehicle.

The forklift vehicle has at least one tilt cylinder for the lift frame positioned substantially parallel to the longitudinal axis of the vehicle and located in the vicinity of the cab roof. The tilt cylinder is fastened to the upper end of at least one vertically extending support column which extends upwardly from the counterweight at the rear of the forklift vehicle. An advantageous refinement of the forklift vehicle is that the tilt cylinder for the lift frame also functions as a support element and when two tilt cylinders are used they are rigidly connected to each other. The use of the tilt cylinders as support elements reduces the load on the frame by eliminating the tilt cylinder forces, since these forces are now transmitted directly to the counterweight.

A single tilt cylinder can be used along with a linear guide parallel to the tilt cylinder mounted on roller bearings or friction bearings. Two linear guides may be located parallel to one another and one or both of the linear guides corresponds to a tilt cylinder. The linear guides are designed to absorb transverse forces.

According to a refinement of the invention which improves stability, two spaced substantially perpendicular support columns are connected to the counterweight on the rear of the vehicle. The distal end of a rod of a tilt cylinder is pivotally connected to the upper end of each support column and the upper ends of the columns are rigidly connected by a cross member. This arrangement produces a structural unit which is extremely stable and is resistant to deformation. The forces introduced into this structural unit by the lift frame and the tilt cylinders are transmitted to the support columns which are connected to the counterweight and the counterweight absorbs the forces without any deformation thereof.

In another embodiment of the invention the distal end of the tube of each tilt cylinder is pivotally connected to the upper end of the lift frame and the distal end of the rod of each tilt cylinder is pivotally connected to the upper end of a support column. The tubes are connected by at least one transverse web member. This arrangement creates a stable truss-like arrangement between the tilt cylinders. Protective struts extending parallel to the longitudinal axis of the forklift vehicle are fastened to the web member. The protective struts are laterally offset relative to other protective struts which are fastened to the cross member connecting the upper ends of the support columns. The spacing between the web members and between the protective struts is selected to insure that no large objects can fall through the protective cover over the cab roof.

Instead of constructing the driver protective cover from struts and web members, protective panels may be used.

The features which characterize the invention are pointed out with particularity in the claims annexed to and forming a part of this disclosure. For a better understanding of the invention, its operating advantages and the specific objects attained by its use, reference should be had to the accompanying drawings and the descriptive matter in which preferred embodiments of the invention are illustrated and described. Like reference characters describe like parts throughout the drawings.

DESCRIPTION OF THE PREFERRED EMBODIMENTS

Figure 1:
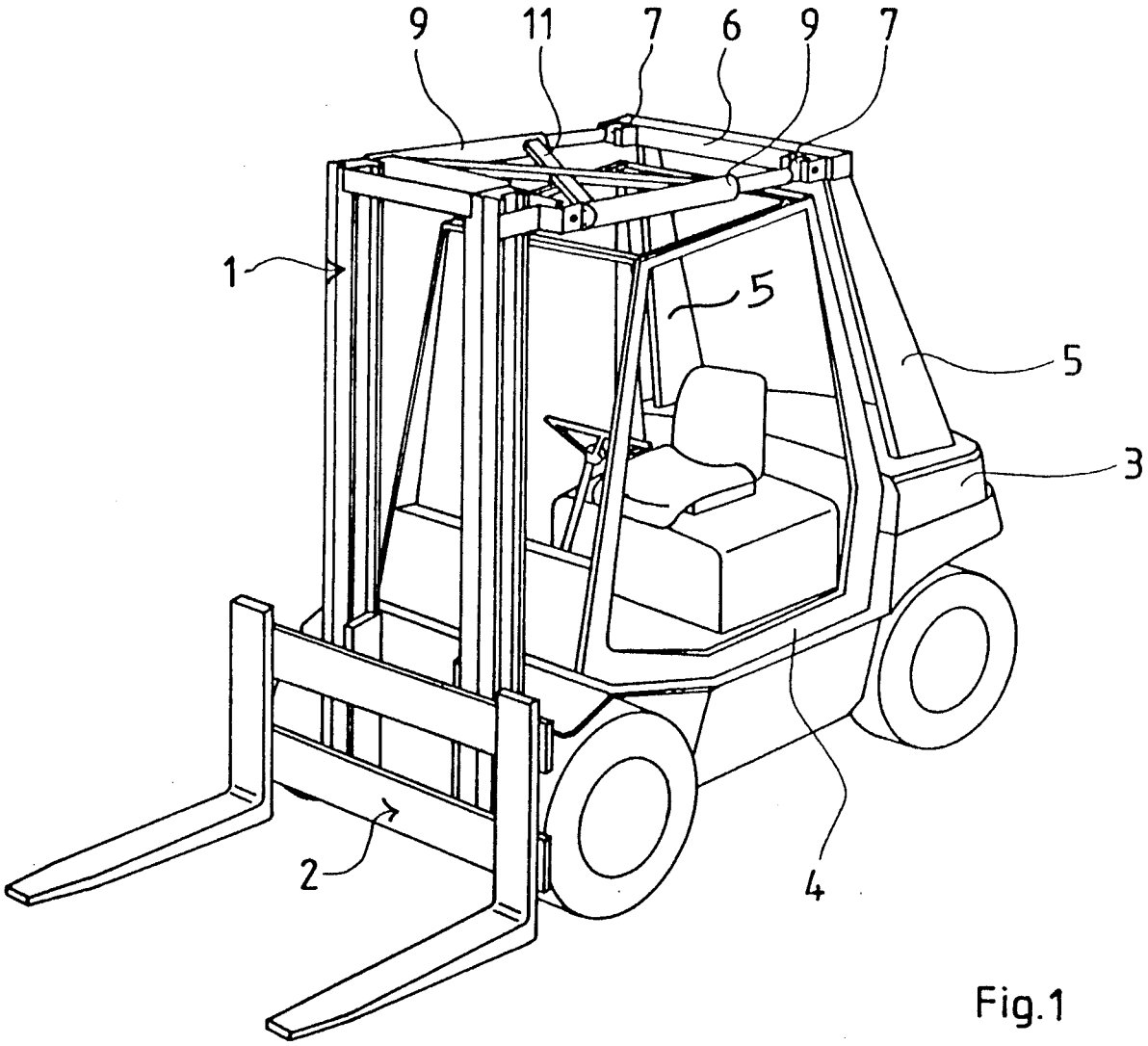
FIG. 1 is a perspective view of a forklift vehicle according to the invention.

FIG. 1 of the drawings shows a forklift vehicle having a lift frame 1 tiltably mounted on a shaft (not shown) located on the front with a carrier rack 2 mounted on the lift frame for vertical movement. The lift frame 1 is tiltable around a substantially horizontal shaft located generally at the level of the vehicle front wheel axle. A counterweight 3 is located on the rear of the forklift vehicle and a driver cab 4 is located between lift frame 1 and counterweight 3. Two spaced support columns 5 are attached to counterweight 3. The support columns extend substantially vertically from counterweight 3 beyond the top of cab 4. The upper ends of support columns 5 are rigidly connected by a cross member 6.

Figure 2:
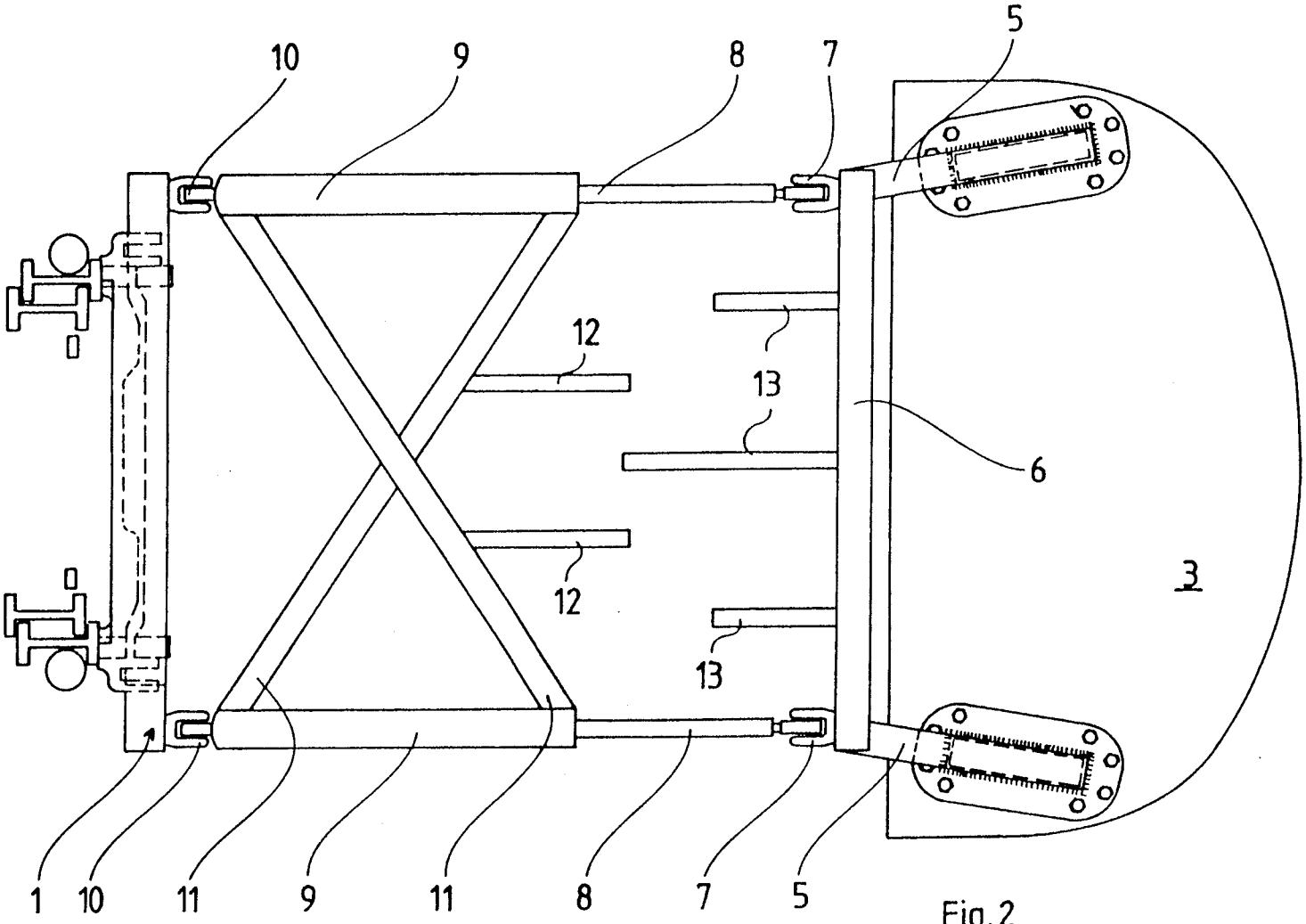
FIG. 2 is a plan view of the forklift vehicle shown in FIG. 1.

As shown in FIG. 2 of the drawings, a clevis 7 is attached to each end of cross member 6 and the distal end of the piston rod 8 of a tilt cylinder 9 is pivotally fastened to a clevis 7. The tilt cylinders are parallel to each other and to the longitudinal axis of the vehicle. The distal end of the tube of each tilt cylinder is pivotally connected to a clevis 10 on the cross member at the upper end of lift frame 1. The ends of the tubes of tilt cylinders 9 are connected by diagonal web members 11. Parallel longitudinal protective struts 12 are connected to the web members 11. Parallel protective struts 13 are connected to cross member 6 and are laterally offset relative to protective struts 12 so that the struts mesh to achieve a gear-like effect. Web members 11; struts 12 and 13 and tilt cylinders 9 form a driver protection cover above cab 4 which prevents objects from falling into the cab and injuring the vehicle driver. The size of the open spaces between web members 11 and struts 12 and 13 is determined by the size of objects which are to be prevented from falling into the cab. If desired, the open spaces can be completely closed by a transparent, high impact cover, which has two halves with a lateral overlap so that when the lift frame is tilted backward the front half of the cover will slide relative to the rear half of the cover and the cover is always closed to prevent even small objects from falling into the cab.

Instead of two tilt cylinders 9 as shown in FIGS. 1 and 2 of the drawings, a single tilt cylinder can be used in which case one of the tilt cylinders is replaced by a linear guide having friction bearings or roller bearings which absorb transverse forces.

Figure 3:
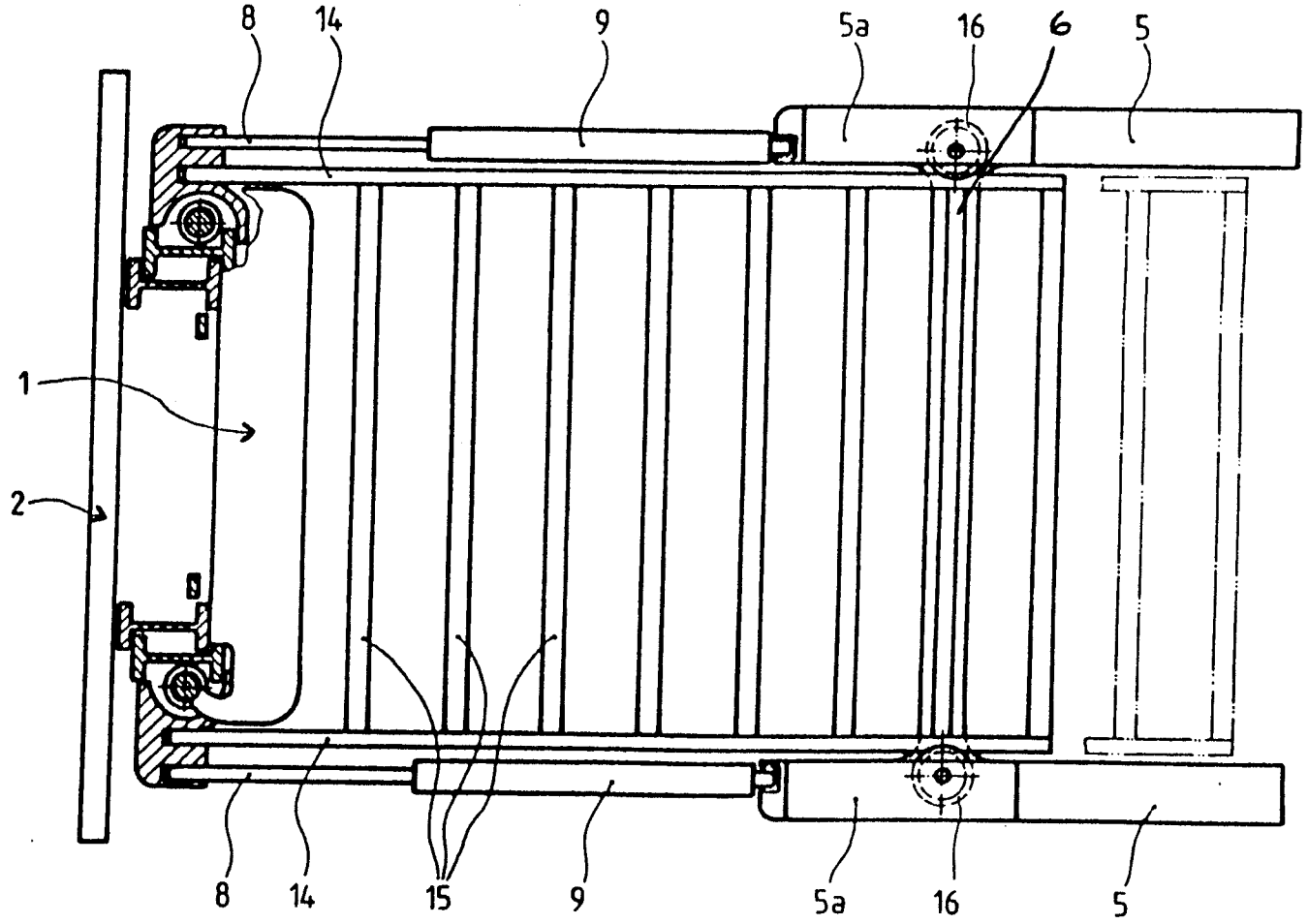
FIG. 3 is a plan view of a second embodiment of the driver cab protective cover.

As shown by the arrangement in FIG. 3 of the drawings, it is also within the scope of the invention to have two linear guides and to utilize a separate tilt cylinder for each guide. Elongated longitudinal members 14 are connected by cross members 15. Each elongated longitudinal member 14 is guided by a roller guide 16 which is mounted on an extension arm 5*a* attached to a support column 5. The cross member 6 which connects the upper ends of the support columns 5 to improve their stability is fastened in the vicinity of extension arms 5*a*. The forward ends of longitudinal members 14 are pivotally connected to lift frame 1. Each tube of a tilt cylinder 9 is pivotally connected to a clevis located at the forward end of an extension arm 5*a*. The distal end of the rod 8 from a tube is pivotally connected to lift frame 1. The protective cover shown in solid lines in FIG. 3 of the drawings is in the extended forward position, and the position of the cover shown in dotted lines is when the lift frame is rearwardly inclined.

In addition to protecting the driver in cab 4, the apparatus described above provides torque resistance because of the rigid transverse connection of tilt cylinders 9 by one or more web members 11. This prevents deformation of the lift frame caused by loads acting on the forks of carrier rack 2. The pivot mountings 7 and 10 prevent warping or twisting during the inclination of the lift frame 1.

The foregoing describes preferred embodiments of the invention and is given by way of example only. The invention is not limited to any of the specific features described herein, but includes all variations thereof within the scope of the appended claims.

I claim:

1. A forklift vehicle having a forward end, a rear end and a longitudinal axis, a tiltable lift frame mounted on said forward end of said vehicle which can be pivoted relative to a horizontal axis located at said forward end of said vehicle transverse to said longitudinal axis of said vehicle, spaced substantially vertical support columns on said rear end of said vehicle, each of said support columns having a distal end and a cross member connecting said distal ends of said support columns, a driver cab on said vehicle, and a protective cover over said driver cab, said protective cover including a pair of tilt cylinders located substantially parallel to said longitudinal axis of said vehicle, each of said tilt cylinders having a tube and a piston rod extending from one end of said tube, each of said piston rods having a distal end pivotally connected to one of said support columns, at least one diagonal web member connecting said tilt cylinders, first protective struts parallel to said longitudinal axis of said vehicle having an end connected to said web member, and second protective struts having an end connected to said cross member, said first protective struts being laterally offset relative to said second protective struts.

2. A forklift vehicle as set forth in claim 1, wherein each of said tubes has a distal end pivotally connected to said tiltable lift frame.

3. A forklift vehicle having a forward end, a rear end and a longitudinal axis, a tiltable lift frame mounted on said forward end of said vehicle which can be pivoted relative to a horizontal axis located at said forward end of said vehicle transverse to said longitudinal axis of said vehicle, spaced substantially vertical support columns on said rear end of said vehicle, each of said support columns having a distal end, an extension arm on said distal end of each of said support columns extending toward said forward end of said vehicle, a cross member connecting said extension arms and a roller guide on each of said extension arms, a driver cab on said vehicle, and a protective cover over said driver cab, said protective cover including a pair of spaced tilt cylinders located substantially parallel to said longitudinal axis of said vehicle, each of said tilt cylinders having a tube and a piston rod extending from one end of said tube, each of said piston rods having a distal end pivotally connected to one of said extension arms, a pair of spaced elongated longitudinal members located substantially parallel to said longitudinal axis of said vehicle, each of said longitudinal members having a forward end pivotally connected to said tiltable lift frame and means for connecting said elongated longitudinal members to each other, whereby each of said elongated longitudinal members contacts one of said roller guides for movement along said longitudinal axis of said vehicle when said tiltable lift frame is pivoted about said horizontal axis.

4. A forklift vehicle as set forth in claim 3, wherein said means for connecting said elongated longitudinal members are spaced cross members connected to said elongated longitudinal members.

5. A forklift vehicle having a forward end, a rear end and a longitudinal axis, a tiltable lift frame pivotally mounted on said forward end of said vehicle for inclination relative to a horizontal axis located at said forward end of said vehicle transverse to said longitudinal axis of said vehicle, spaced substantially vertical support columns on said rear end of said vehicle, each of said spaced support columns having a distal end, means for connecting said distal ends of said spaced support columns, a driver cab on said vehicle between said forward end and said rear end, a protective cover located above said driver cab, said protective cover including a pair of spaced extendable and retractable tube and rod means for pivoting said tiltable lift frame relative to said horizontal axis, said tube and rod means located substantially parallel to said longitudinal axis of said vehicle and one of said pair of tube and rod means located on each side of said longitudinal axis of said vehicle, each of said tube and rod means having a first end pivotally connected to said tiltable lift frame and a second end pivotally connected to said means for connecting said distal ends of said spaced support columns, means located between said tube and rod means for forming a portion of said protective cover over said driver cab, said means located between said tube and rod means including a plurality of members positioned at an angle to said longitudinal axis of said vehicle.

* * * * *